US008460126B2

(12) United States Patent
Sullivan et al.

(10) Patent No.: US 8,460,126 B2
(45) Date of Patent: Jun. 11, 2013

(54) GOLF BALL SURFACE PATTERNS COMPRISING VARIABLE WIDTH/DEPTH MULTIPLE CHANNELS

(75) Inventors: Michael J. Sullivan, Barrington, RI (US); Steven Aoyama, Marion, MA (US); Edmund A. Hebert, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 13/269,137

(22) Filed: Oct. 7, 2011

(65) Prior Publication Data

US 2012/0088608 A1 Apr. 12, 2012

Related U.S. Application Data

(60) Division of application No. 12/356,632, filed on Jan. 21, 2009, now Pat. No. 8,033,933, which is a continuation-in-part of application No. 12/233,649, filed on Sep. 19, 2008, now Pat. No. 8,137,216, which is a continuation-in-part of application No. 11/025,952, filed on Jan. 3, 2005, now Pat. No. 7,588,505, and a continuation-in-part of application No. 12/061,779, filed on Apr. 3, 2008, now Pat. No. 7,867,109, which is a continuation-in-part of application No. 11/141,093, filed on May 31, 2005, now Pat. No. 7,455,601, which is a division of application No. 10/077,090, filed on Feb. 15, 2002, now Pat. No. 6,905,426.

(51) Int. Cl.
*A63B 37/12* (2006.01)

(52) U.S. Cl.
USPC ..... 473/384

(58) Field of Classification Search
USPC ..... 473/383–384
See application file for complete search history.

(56) References Cited

U.S. PATENT DOCUMENTS

| | | | |
|---|---|---|---|
| 1,666,699 | A | 4/1928 | Hagen |
| 2,002,726 | A | 5/1935 | Young |
| 4,090,716 | A | 5/1978 | Martin et al. |
| 4,284,276 | A | 8/1981 | Worst |
| 4,681,323 | A | 7/1987 | Alaki |
| 4,762,326 | A | 8/1988 | Gobush |
| 4,765,626 | A | 8/1988 | Gobush |
| 4,772,026 | A | 9/1988 | Gobush |
| 4,787,638 | A | 11/1988 | Kobayashi |
| 4,830,378 | A | 5/1989 | Aoyama |
| 4,869,512 | A | 9/1989 | Nomura |

(Continued)

FOREIGN PATENT DOCUMENTS

| | | |
|---|---|---|
| GB | 2103939 A | 3/1983 |
| JP | 07-289662 | 7/1996 |
| JP | 2001-321460 | 11/2001 |
| WO | WO 00/48687 | 2/2000 |

*Primary Examiner* — Raeann Gorden
(74) *Attorney, Agent, or Firm* — Mandi B. Milbank

(57) ABSTRACT

A golf ball having an improved surface pattern is disclosed. The golf ball has one or more bands on its surface. These bands may be either channels or raised beads. The bands have variable widths and/or heights/depths, either within the same band or between bands. These bands may decrease drag, or may increase lift. These bands may be linear, or may be curved, and may or may not fully circumscribe the golf ball. These channels or ridges may also be combined with traditional or non-traditional dimples.

17 Claims, 17 Drawing Sheets

U.S. PATENT DOCUMENTS

| | | | | |
|---|---|---|---|---|
| 4,979,747 | A | 12/1990 | Jonkouski | |
| 4,991,852 | A | 2/1991 | Pattison | |
| 5,005,838 | A | 4/1991 | Oka | |
| 5,158,300 | A | 10/1992 | Aoyama | |
| 5,174,578 | A | 12/1992 | Oka et al. | |
| 5,338,039 | A | 8/1994 | Oka et al. | |
| 5,377,989 | A | 1/1995 | Machin | |
| 5,470,076 | A | 11/1995 | Codorniga | |
| 5,503,398 | A | 4/1996 | Lu | |
| 5,536,013 | A | 7/1996 | Pocklington | |
| 5,547,197 | A | 8/1996 | Pocklington | |
| 5,566,943 | A | 10/1996 | Boehm | |
| 5,601,503 | A | 2/1997 | Yamagishi et al. | |
| 5,735,757 | A | 4/1998 | Moriyama | |
| 5,857,924 | A | 1/1999 | Miyagawa et al. | |
| 5,879,245 | A | 3/1999 | Hwang | |
| 5,957,787 | A | 9/1999 | Hwang | |
| 6,059,671 | A | 5/2000 | Asakura | |
| 6,162,136 | A | 12/2000 | Aoyama | |
| 6,176,793 | B1 | 1/2001 | Sullivan et al. | |
| 6,290,615 | B1 | 9/2001 | Ogg | |
| 6,383,092 | B1 | 5/2002 | Ogg | |
| 6,475,105 | B1 | 11/2002 | Murphy | |
| 6,632,150 | B1 | 10/2003 | Ogg | |
| 6,905,426 | B2 | 6/2005 | Morgan et al. | |
| 7,309,298 | B2 | 12/2007 | Morgan et al. | |
| 7,455,601 | B2 | 11/2008 | Morgan et al. | |
| 8,033,933 | B2 * | 10/2011 | Sullivan et al. | 473/384 |
| 8,137,216 | B2 * | 3/2012 | Sullivan et al. | 473/383 |
| 2002/0025864 | A1 | 2/2002 | Barfield | |
| 2004/0005937 | A1 | 1/2004 | Saiz | |
| 2004/0224042 | A1 | 11/2004 | Tzivanis et al. | |
| 2006/0148591 | A1 | 7/2006 | Hebert et al. | |
| 2006/0281583 | A1 | 12/2006 | Sato et al. | |
| 2007/0026971 | A1 | 2/2007 | Aoyama et al. | |

* cited by examiner

GOLF BALL SURFACE PATTERNS COMPRISING VARIABLE WIDTH/DEPTH MULTIPLE CHANNELS

CROSS-REFERENCE TO RELATED PATENT APPLICATIONS

This application is a divisional of U.S. patent application Ser. No. 12/356,632, filed Jan. 21, 2009 now U.S. Pat. No. 8,033,933, which is a continuation-in-part of U.S. patent application Ser. No. 12/233,649, filed on Sep. 19, 2008 now U.S. Pat. No. 8,137,216. U.S. patent application Ser. No. 12/233,649 is a continuation-in-part of Ser. No. 11/025,952, filed on Jan. 3, 2005, now U.S. Pat. No. 7,588,505, and U.S. patent application Ser. No. 12/061,779, filed on Apr. 3, 2008, now U.S. Pat. No. 7,867,109. U.S. patent application Ser. No. 12/061,779 is a continuation-in-part of U.S. patent application Ser. No. 11/141,093, filed on May 31, 2005, now U.S. Pat. No. 7,455,601, which is a divisional of U.S. patent application Ser. No. 10/077,090 filed on Feb. 15, 2002, now U.S. Pat. No. 6,905,426. The entire disclosure of each of these related applications is hereby incorporated herein by reference.

FIELD OF THE INVENTION

The present invention relates to golf balls, and more particularly, to golf balls having improved surface patterns. More specifically, the present invention relates to golf balls having variable width/depth ridges or channels on the golf ball surface.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities, thus different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on a traditional golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the boundary layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which allows dimples to create the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to improve ball performance, it is desirable to have a large number of dimples, hence a large amount of dimple circumference. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.100 inches to about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness.

Golf ball manufacturers continue to search for more efficient methods of changing the surface of a golf ball in order to improve the aerodynamics or to impart unique aerodynamic properties to golf balls.

SUMMARY OF THE INVENTION

The present invention is directed to a golf ball with improved surface patterns. More specifically, the present invention relates to golf balls having a system of variable width and/or height/depth ridges or channels on the golf ball surface. Preferably, the depth of the deepest portions of the ridges or channels may be from about 0.005 inches to about 0.030 inches, more preferably from about 0.010 inches to about 0.020 inches. Preferably, the width of the widest points of the ridges or channels may be from about 0.050 inches to about 0.250 inches, more preferably from about 0.100 inches to about 0.200 inches.

The present invention is further directed to a golf ball comprising a substantially spherical outer surface and a channel system comprising one or more variable width and/or depth channels formed thereon. The channels of the present invention may be straight or curved, may or may not circumscribe the golf ball. The channels may also be discontinuous. The channels may or may not intersect other channels. They may cover as much of the ball surface as desired, up to virtually 100%, but preferably the surface coverage of the channels is less than about 40%, preferably less than about 30%, or less than about 20% or less than about 10%. The lower percentages are more preferable in cases where the channels are combined with other types of surface texture such as conventional dimples.

In some embodiments, these channels may allow the golf ball to have orientation-specific aerodynamic properties, i.e., to fly differently depending on its orientation when hit off of a tee. In other embodiments, the channels allow the ball to have greater flight symmetry. In some embodiments, there may be both channels and dimples or other features on the surface of the golf ball.

BRIEF DESCRIPTION OF THE DRAWINGS

Further features and advantages of the invention can be ascertained from the following detailed description that is provided in connection with the drawings described below.

DETAILED DESCRIPTION

Figure 1:
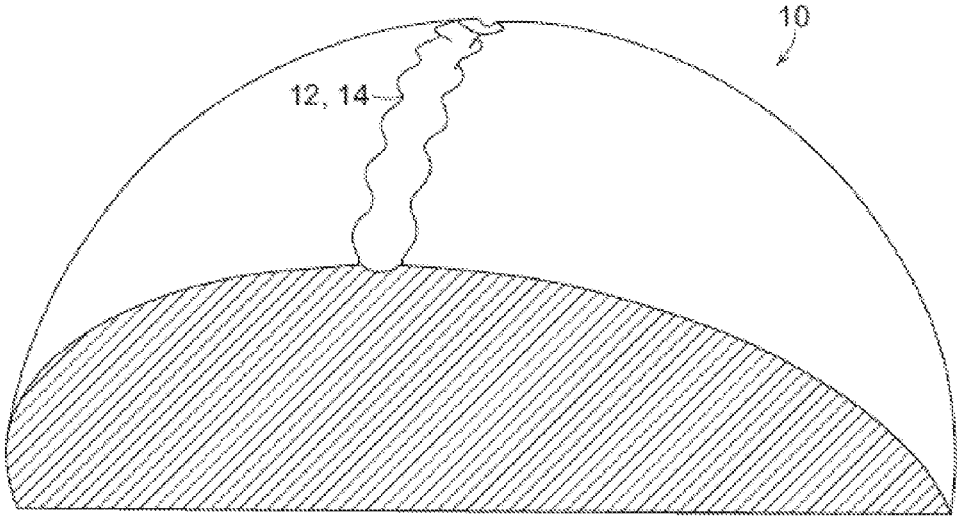
FIGS. 1-11 show exemplary channel patterns for golf balls of the present invention.

In one embodiment as illustrated in FIGS. 1-12, the present invention comprises a golf ball 10 having a system of bands, comprising one or more bands 12 to improve the ball's aerodynamics. Bands 12 are disclosed in the parent case, albeit with smooth side edges and without features to enhance the bands' appearance and aerodynamic properties, as described and claimed herein. A band 12 may be a surface channel 14, as in FIGS. 1-11, or a raised bead 16, as in FIG. 12. Channels 14 have an elevation lower than the outer surface of ball 10, and beads 16 have an elevation higher than the outer surface of ball 10. Bands 12 have a variable width and/or depth/height, either within the same band (intra-band) or between bands (inter-band), and may be continuous or discontinuous. Bands 12 may have any desired shape or pattern. This may include, but is not limited to, geometric patterns, fractal patterns, irregular patterns, linear and non-linear lines, and the like. In one embodiment, it may be desirable for the pattern to be a combination of at least two of geometric patterns, fractal patterns, irregular patterns, and lines. Golf ball 10 may have a single band 12 that transcribes the ball as illustrated in FIGS. 1-12 or may comprise multiple intersecting or non-intersecting bands 12, as illustrated in FIGS. 13-26. Bands 12 may have any shape, including, but not limited to linear, circular, oval, arcuate, sinusoid, irregular, or combinations thereof. Bands 12 may comprise concave or convex features thereon. Bands 12 may be intersecting, overlapping, non-intersecting, or any combination thereof. Bands may also intersect or overlap with other surface features, such as dimples, inverted dimples, or surface textures. Bands of the present invention may also have any of a variety of cross-sectional shapes, including, but not limited to, semicircular, parabolic, hyperbolic, polygonal, catenary, or irregular, and may have secondary sub-bands or sub-dimples. The cross-sectional shape of a band may also vary or change throughout the length of the band.

As seen in FIGS. 13-26, golf ball 10 may comprise multiple bands 12. Bands 12 may comprise channels 14, beads 16, or a combination thereof. FIGS. 15-26 are disclosed in related application Ser. No. 11/025,952 and published as U.S. 2006/0148591, which is incorporated by reference herein in its entirety. Where ball 10 comprises multiple bands, ball 10 may also comprise one or more hubs 18. Bands 12 may intersect at hubs 18. Additional bands 12 may also begin or end at hubs 18. Hubs 18 may have any shape, and may have an elevation lower than the surface of ball 10 or an elevation higher than the surface of ball 10. Where all bands 12 are channels, hubs 18 preferably have an elevation lower than the surface of ball 10. Conversely, where all bands 12 are beads, hubs 18 preferably have an elevation higher than the surface of ball 10.

Preferably, bands 12 have a depth or height which varies along their length by between about 0.002 inches and about 0.025 inches. More preferably bands 12 have a depth or height which varies along their length by between about 0.005 inches and about 0.015 inches. Preferably, bands 12 have a depth or height at their deepest or highest points of at least about 0.005 inches and less than about 0.030 inches. More preferably, bands 12 have a depth or height at their deepest or highest points of at least about 0.010 inches and less than about 0.020 inches. Preferably, bands 12 have a width which varies along their length by between about 0.005 inches and about 0.245 inches. More preferably, bands 12 have a width which varies along their length by between about 0.010 inches and 0.195 inches. Preferably, bands 12 have a width at their widest points of at least about 0.050 inches and less than about 0.250 inches. More preferably, bands 12 have a width at their widest points of at least about 0.100 inches and less than about 0.200 inches.

Figure 27:
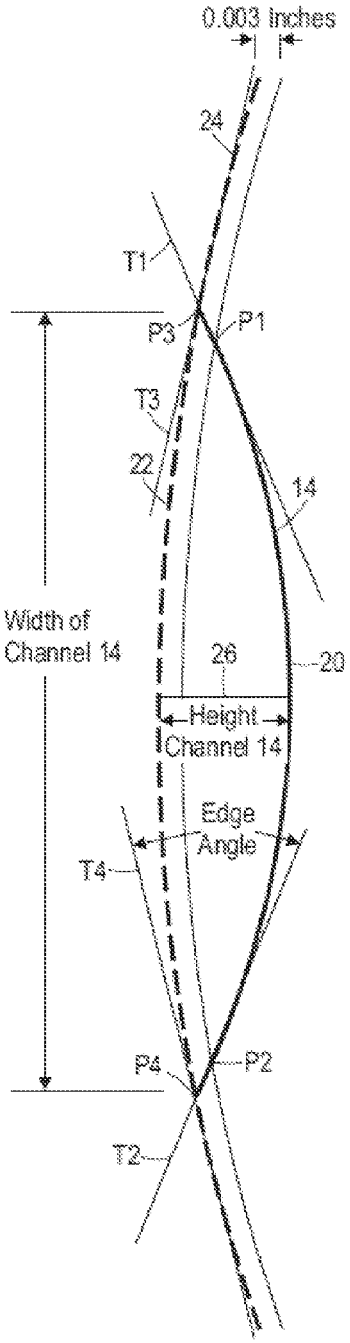
FIG. 27 is a diagram showing a preferred way to measure the depth of a channel of the present invention.
Figure 28:
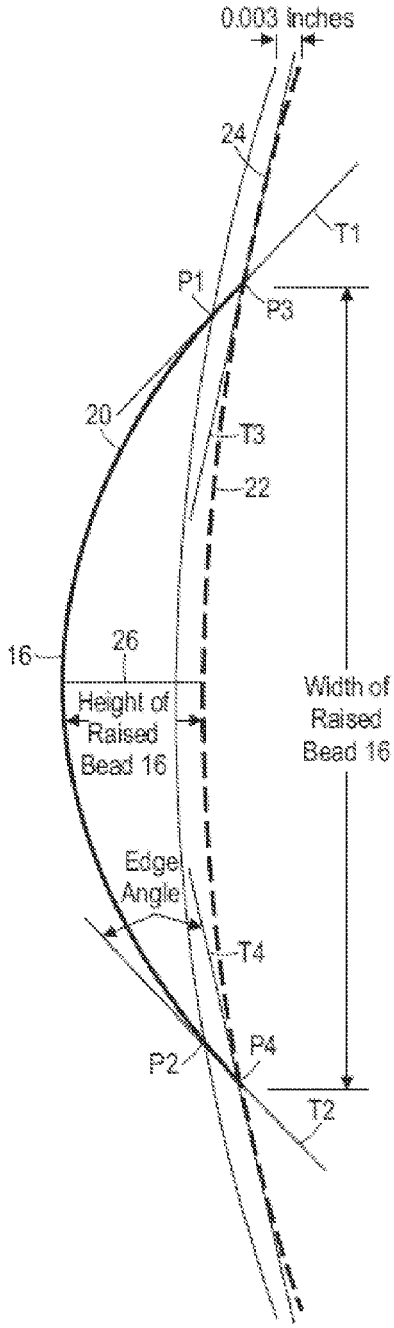
FIG. 28 is a diagram showing a preferred way to measure the height of a raised bead of the present invention.

Generally, it can be difficult to define and measure the width, depth or height, and edge angle of an irregular band due to the relative change in the depth or height due to the shape of the band as compared to the uninterrupted curvature of the ball. FIG. 27 shows a cross-sectional profile 20 taken perpendicularly across channel 14 extending between the land surfaces to either side of the channel 14. Due to the effects of ball curvature, the irregular shape of some channels, the depth of a channel is somewhat ambiguous. To resolve this problem, phantom ball surface 22 is constructed above channel 14 as a continuation of land surface 24. Then, at each local minimum on the channel profile, a line 26 is constructed perpendicular to phantom ball surface 22, wherein line 26 will pass through the center of ball 10. Depth of each local minimum along the cross-sectional profile can be determined by measuring the length of line 26 between the channel 14 and the phantom ball surface 22. The depth of channel 14 is the greatest of the depths of the local minima. Similarly, due to the effects of paint and/or the depression design itself, the junction between land surface 24 and channel 14 is not a sharp corner and is therefore indistinct, rendering the width and edge angle of channel 14 somewhat ambiguous. To resolve this problem, a first tangent line T1 is constructed at a point P1 on a sidewall of channel 14 that is spaced about 0.003 inches radially inward from phantom ball surface 22. T1 intersects phantom ball surface 22 at a point P3, which defines a first nominal edge position. Similarly, a second tangent line T2 is constructed in a similar manner on the sidewall opposite the sidewall used to generate T1. T2 intersects phantom ball surface 22 at point P4, which defines a second nominal edge position. The width of channel 12 is the distance between points P3 and P4. To determine the edge angles, third and fourth tangent lines T3 and T4 are constructed at points P3 and P4, respectively, on the phantom ball surface 22. The edge angle at one side of the channel is the angle between T1 and T3, and the edge angle at the other side is the angle between T2 and T4. FIG. 28 shows a cross-sectional profile 20 taken perpendicularly across a raised bead 16, in a manner similar to FIG. 27. While the procedure for determining the width, height, and edge angles of raised bead 16 are similar to the procedure for determining the width, depth, and edge angles of channel 14, there are several differences. First, local maxima on cross-sectional profile 20 are used to determine line(s) 26, and the height of bead 16 is the greatest of the heights of the local maxima. Second, tangent lines T1 and T2 are constructed tangent to the sidewalls at points 0.003 inches radially outward from phantom ball surface 22. Points P3 and P4 are constructed as described above, and the width of bead 16 is the distance between points P3 and P4.

Figure 13:
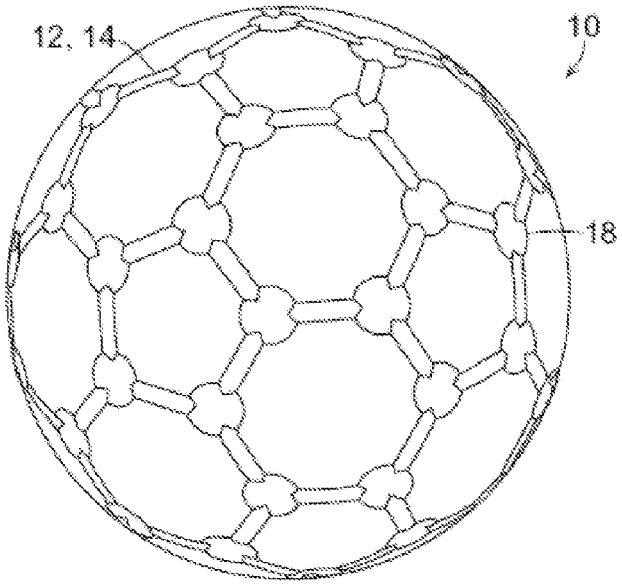
FIGS. 13 to 26 show exemplary channel patterns comprising hubs for golf balls of the present invention.
Figure 14:
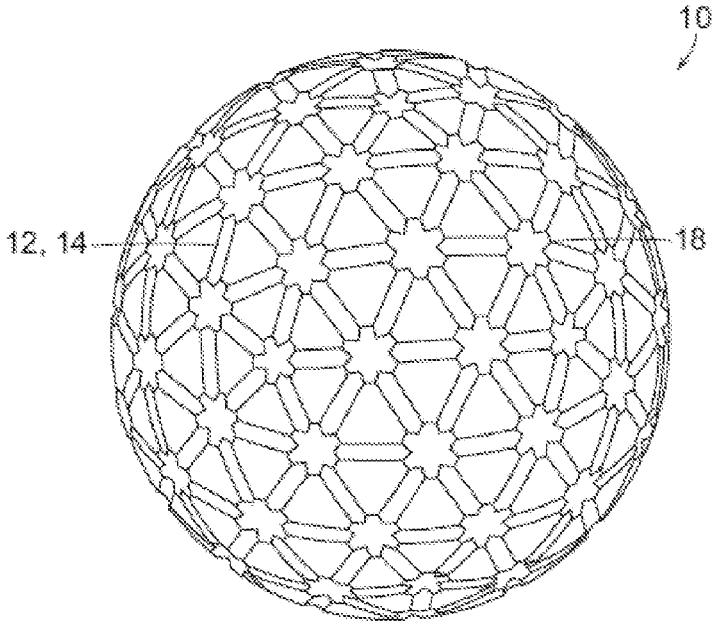
Figure 15:
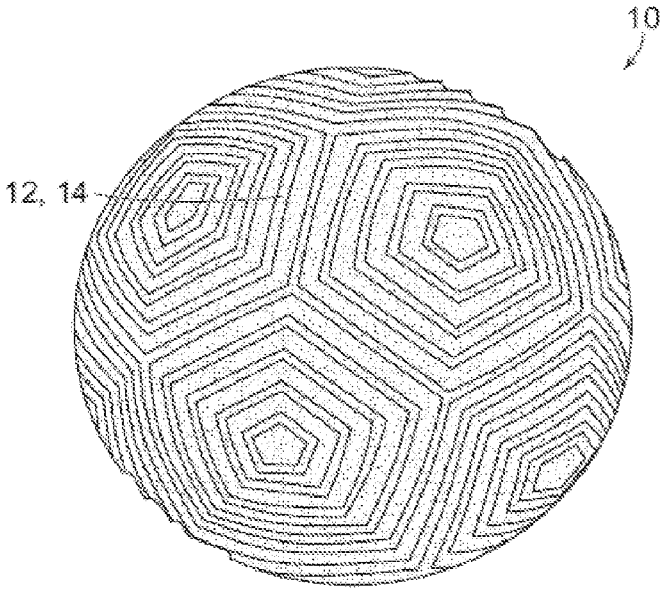
Figure 16:
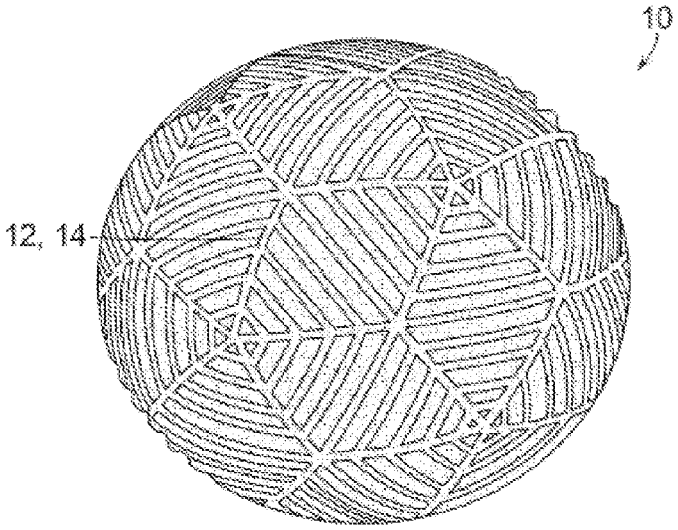
Figure 17:
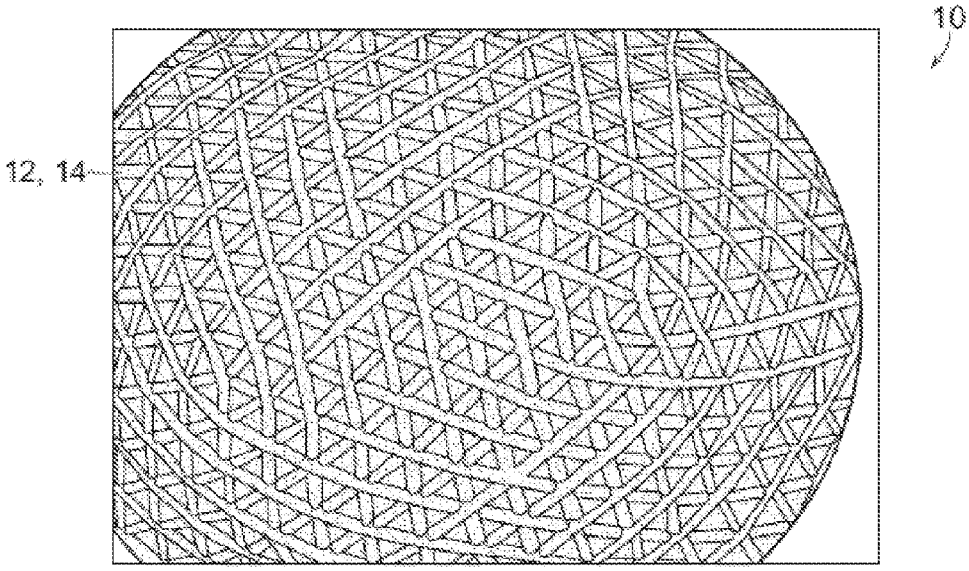
Figure 18:
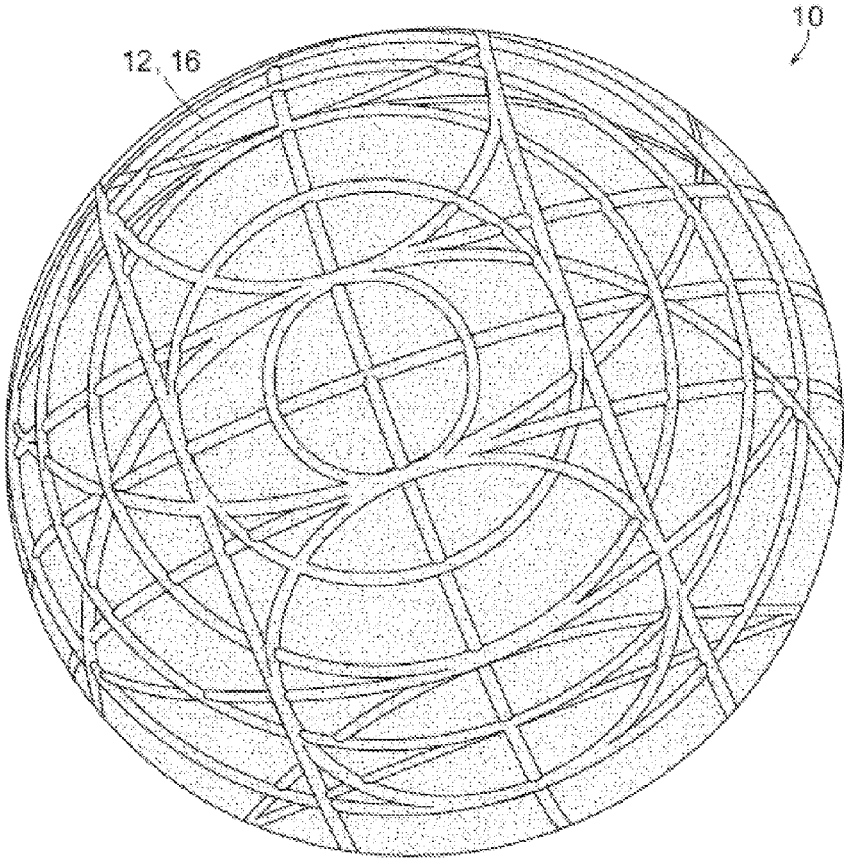
Figure 19:
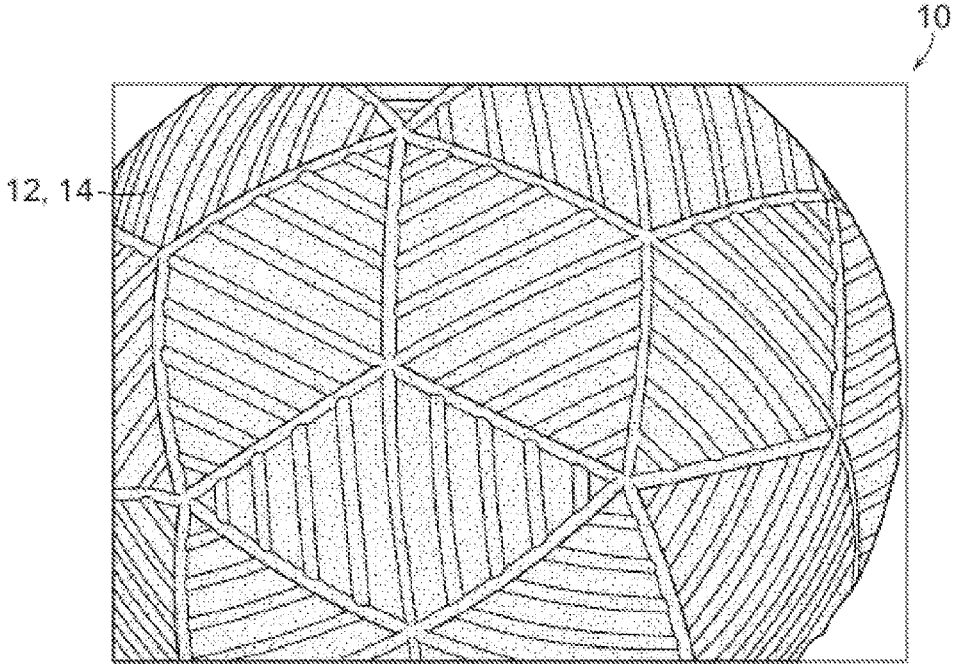
Figure 20:
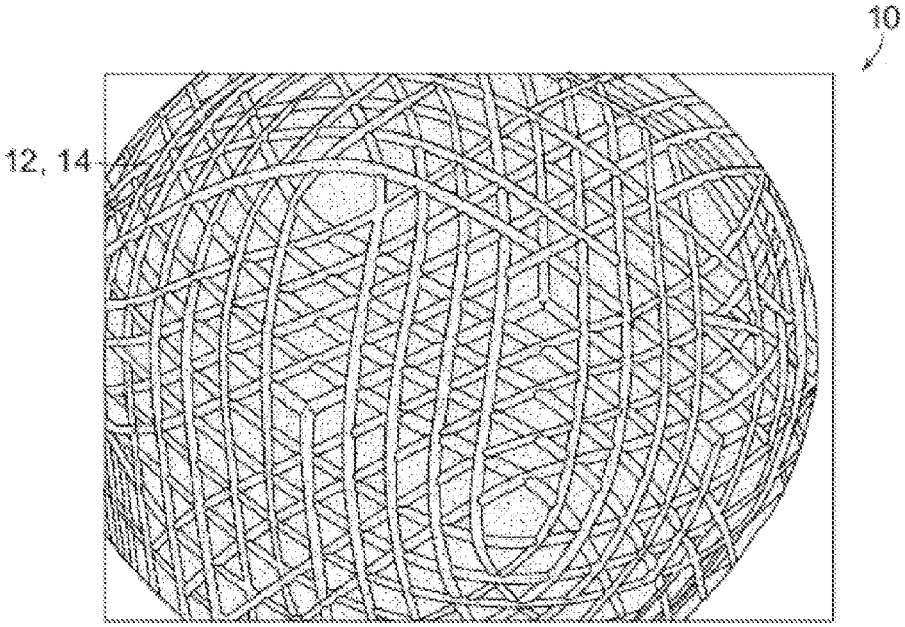
Figure 21:
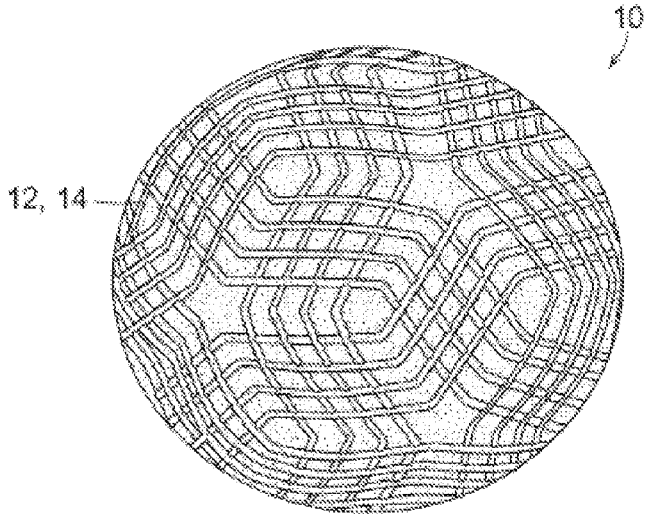
Figure 22:
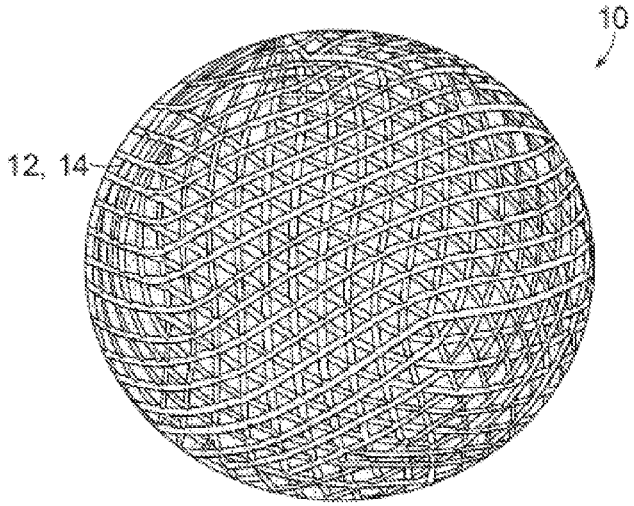
Figure 23:
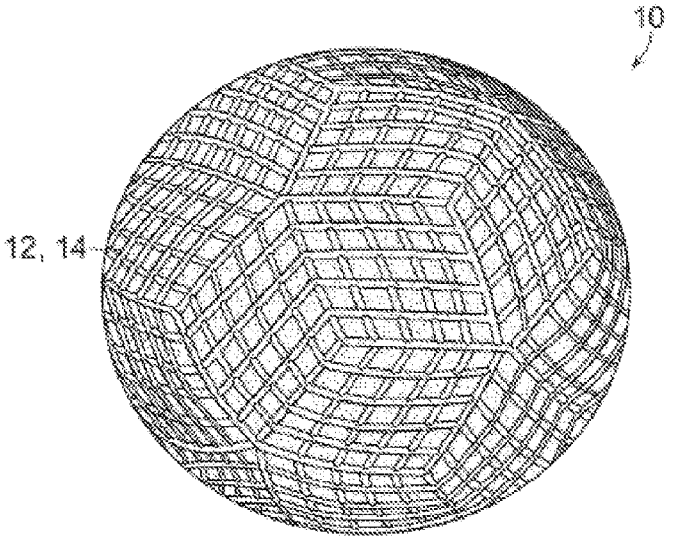

Referring to FIG. 1, ball 10 has a band system comprising at least a single channel 14 that circumscribes ball 10. In this embodiment, channel 14 has a width that varies sinusoidally between about 0.067 inches and about 0.120 inches. Channel 14 comprises about 6 percent of the surface of ball 10. As shown in FIGS. 13-14, ball 10 has a band system comprising a plurality of channels 14 and hubs 18. In the embodiment of FIG. 14, the band system comprises about 54 percent of the ball surface. Thus, bands 12 may comprise a large percentage of the ball surface, but in accordance with one aspect of the present invention, they preferably comprise about 40 percent or less of the ball surface, more preferably, about 30 percent or less, about 20 percent or less, or about 10 percent or less. The combination of relatively low coverage and variable width and height/depth provides a unique aerodynamic package for golf ball 10 that cannot be achieved with conventional circular dimples alone.

Figure 2:
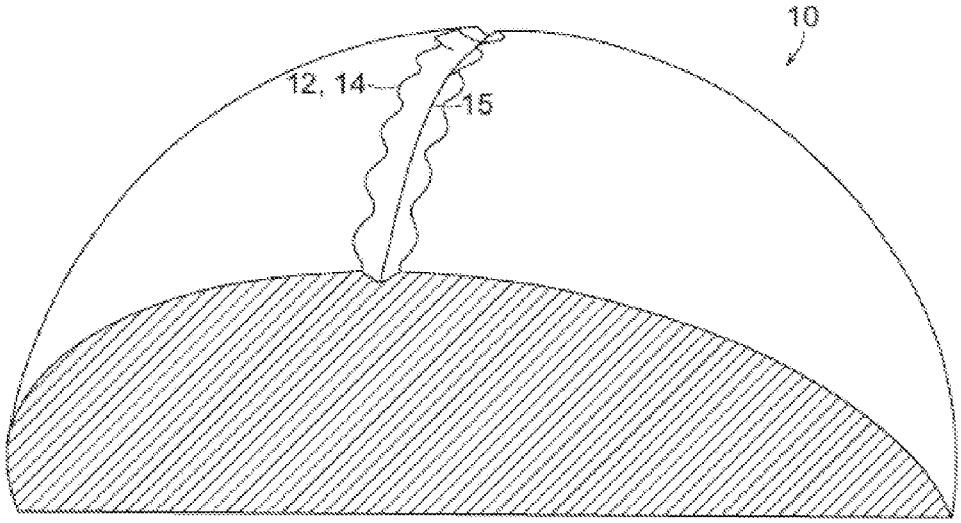
Figure 3:
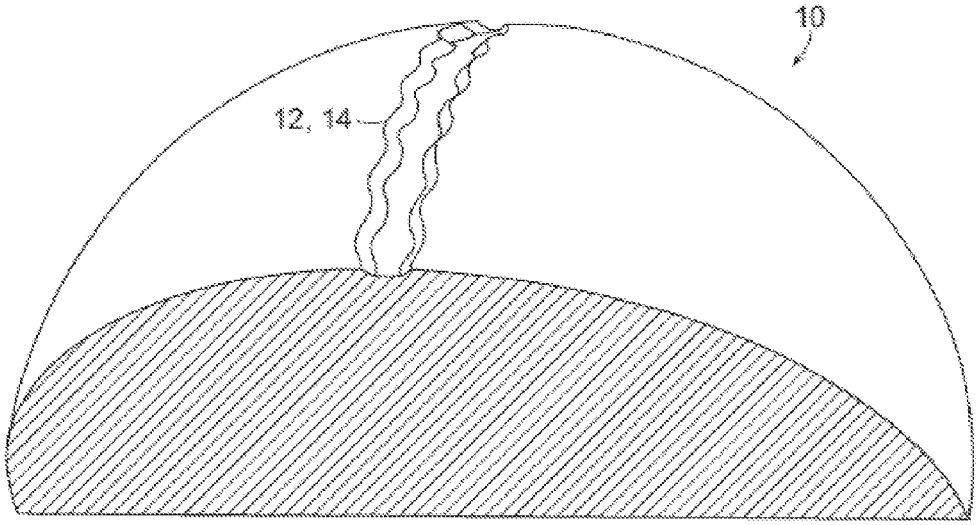
Figure 4:
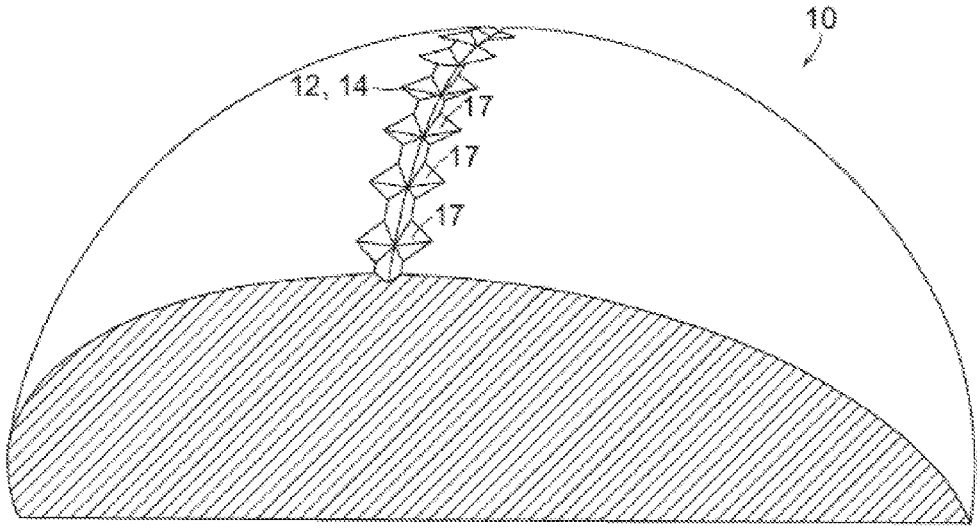
Figure 5:
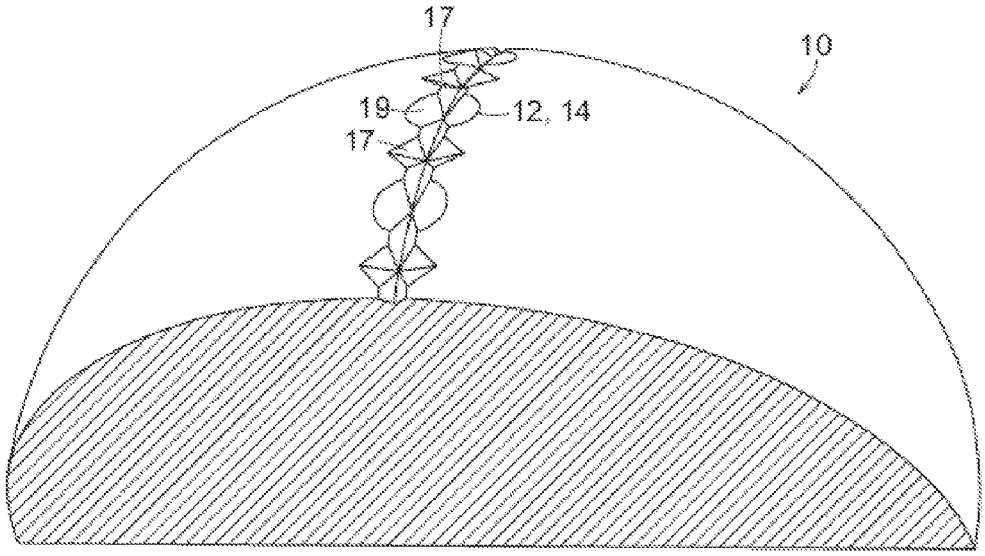
Figure 6:
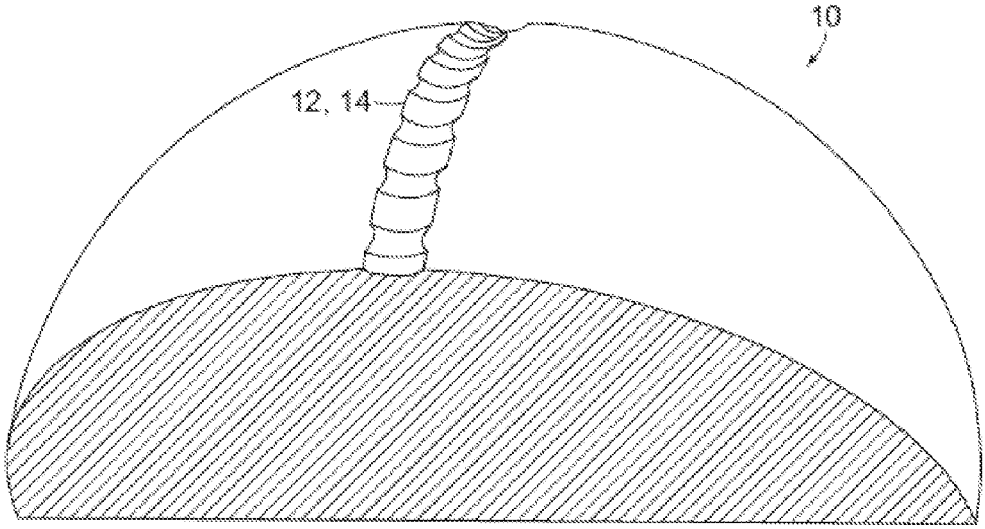
Figure 7:
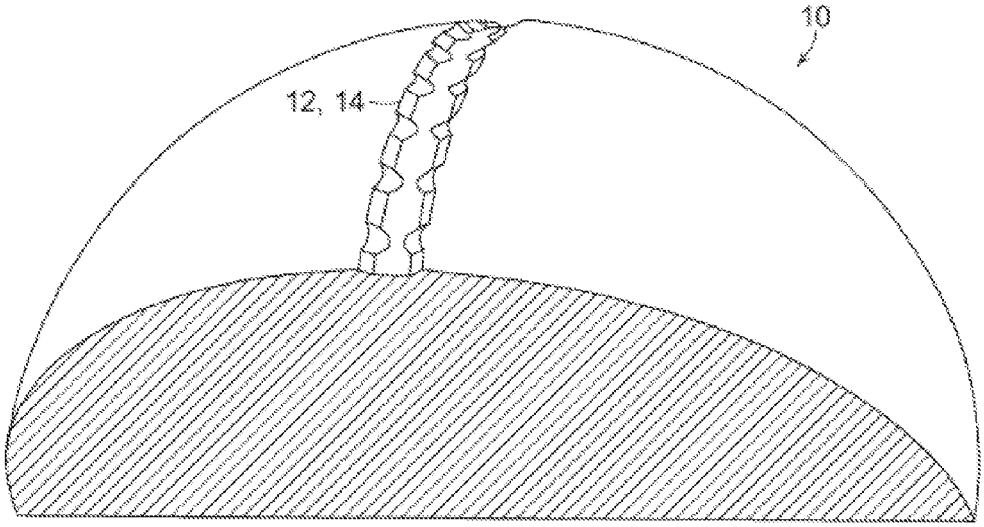
Figure 8:
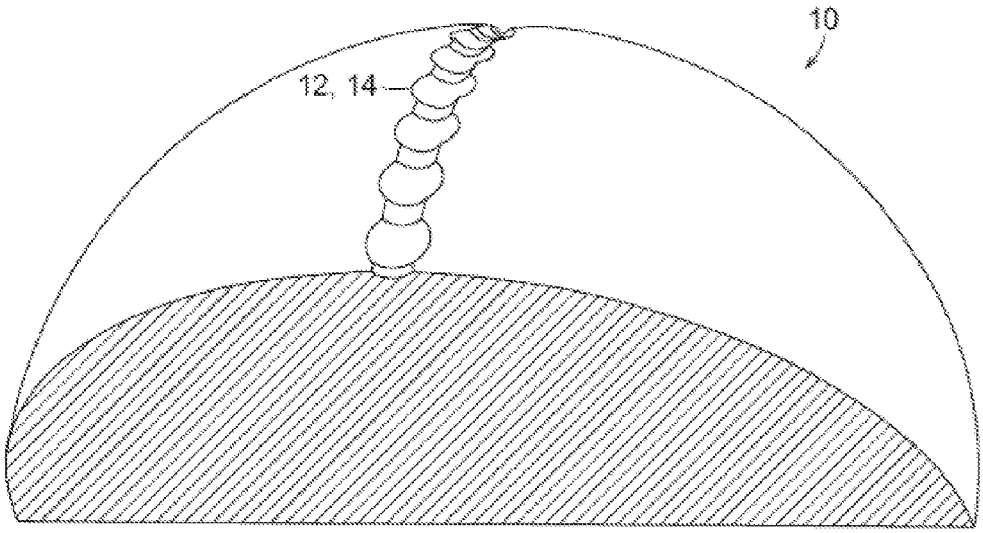
Figure 9:
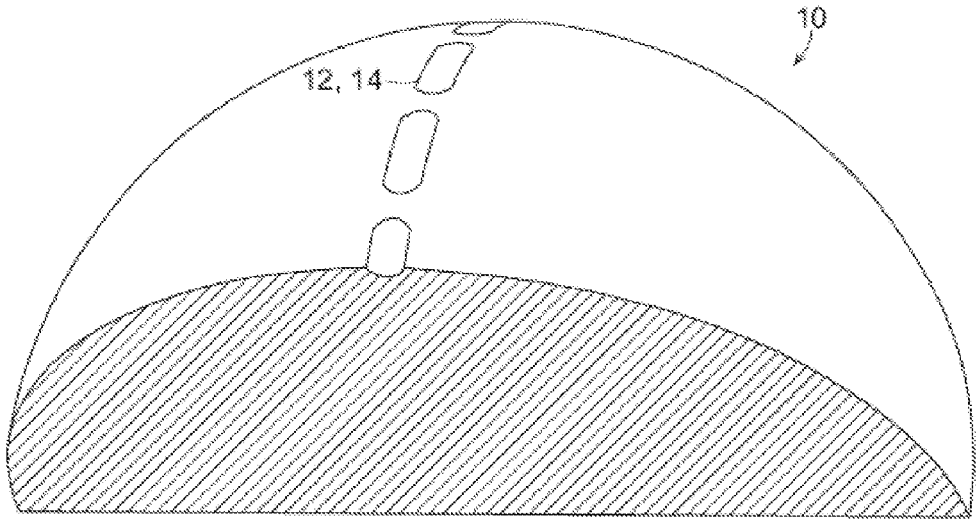
Figure 10:
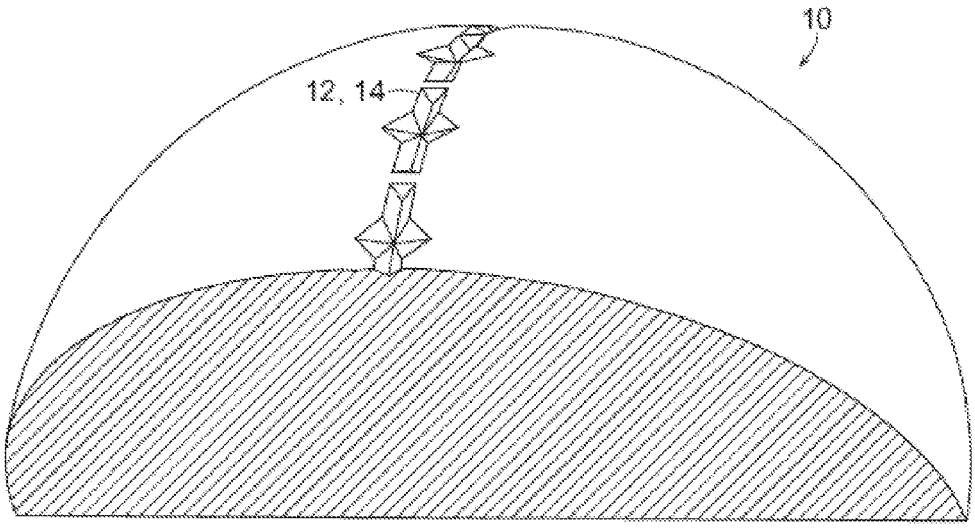
Figure 11:
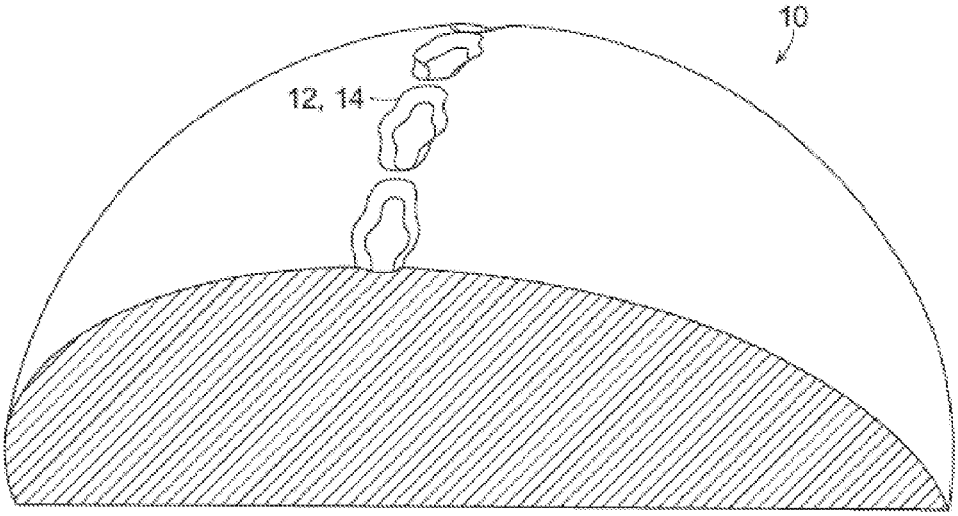
Figure 12:
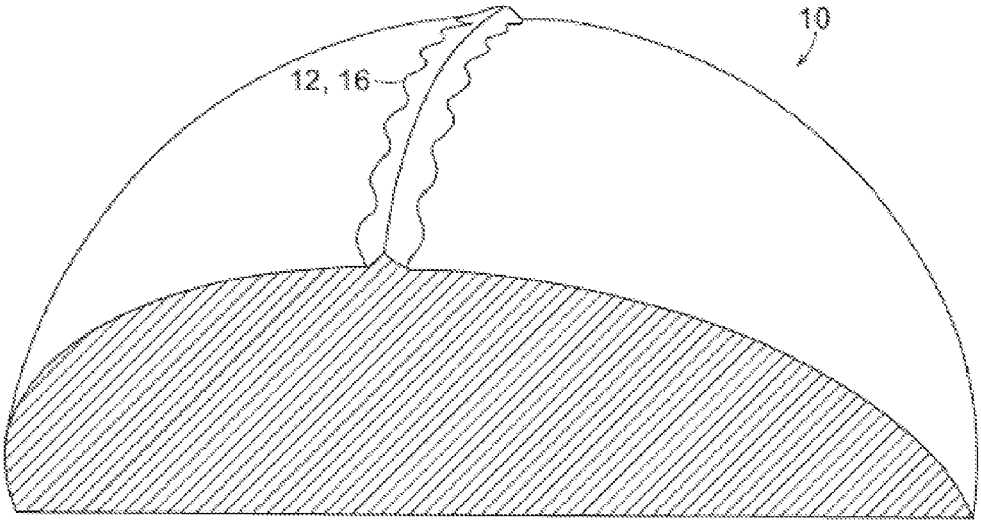
FIG. 12 shows an exemplary raised bead pattern for golf balls of the present invention.

FIG. 2 illustrates a channel 14 similar to that of FIG. 1, except that a wavy channel 14 has a substantially V-shaped bottom with line 15 representing the lowest portion of the channel. FIG. 3 also illustrates a channel 14 that is similar to that of FIG. 1, except that the bottom of the channel is substantially flat. The junctions between the substantially flat bottom and the sidewalls of the channel produce wavy lines that are substantially in phase with their corresponding channel edges. Alternatively, the wavy lines are substantially out of phase. FIG. 4 illustrates a channel 14 that comprises a plurality of starburst shapes 17 connected in series to each other. FIG. 5 illustrates an alternative comprising starbursts 17 separated by round or oval shapes 19. Channel 14 can be segmented as shown in FIG. 6 and in FIG. 8, wherein the segments can be round or oval. FIG. 7 shows that channel 14 can have segmented sidewalls and a substantially flat bottom. Channel 14 may comprise a broken line, as shown in FIG. 9. Starbursts 17 can also be separated or spaced apart, as shown in FIG. 10, as can more rounded shapes as shown in FIG. 11.

As shown in FIGS. 1-12, the edges of channel 14 or bead 16 are not straight or smooth similar to those disclosed in the parent application, but these edges are wavy, jagged, broken. As a result, the width of channels 14 and beads 16 are preferably varying or non-constant.

Channels 14 may comprise a large percentage of the ball surface, but in accordance with one aspect of the present invention, they preferably comprise about 40% or less of the ball surface, more preferably about 30% or less, about 20% or less or about 10% or less. The lower percentages are more preferable in cases where the channels are combined with other types of surface texture such as conventional dimples. The combination of a relatively low coverage of the ball surface, i.e., about 40% or less, and relatively steep edge angle, i.e., about 16° or more, provides a unique aerodynamic package for golf ball 10 of the present invention that cannot be achieved with conventional circular dimples alone.

Preferably, channels 14 have an edge angle that is steeper than edge angles for conventional circular dimples. In one example, channels 12 have substantially the same depth as conventional circular dimples, but have a width that is significantly less than the diameter of conventional circular dimples, causing the edge angle to be steeper than the edge angle of conventional circular dimples, which typically ranges from 12°-16°. The edge angle of channels 12 is preferably greater than about 16°, more preferably greater than about 18°, and more preferably greater than about 20°. The edge angle can range from about 16° to about 90°, preferably from about 18° to about 40°, and more preferably from about 20° to about 30°. Referring to FIG. 27, the edge angles are the angles between lines T1 and T3 on one side of the channel, and T2 and T4 on the other side. The edge angles on the two sides usually, but not always, agree.

One advantage of having relatively low surface coverage is that golf ball 10 behaves more like a true sphere and less like a faceted object when putting. This results in a truer direction of departure from the putter face, and a truer roll along the ground. This would be advantageous to all golfers, but especially to highly skilled golfers who will enjoy the full benefit of their putting skills because of the reduced influence of randomness.

Figure 24:
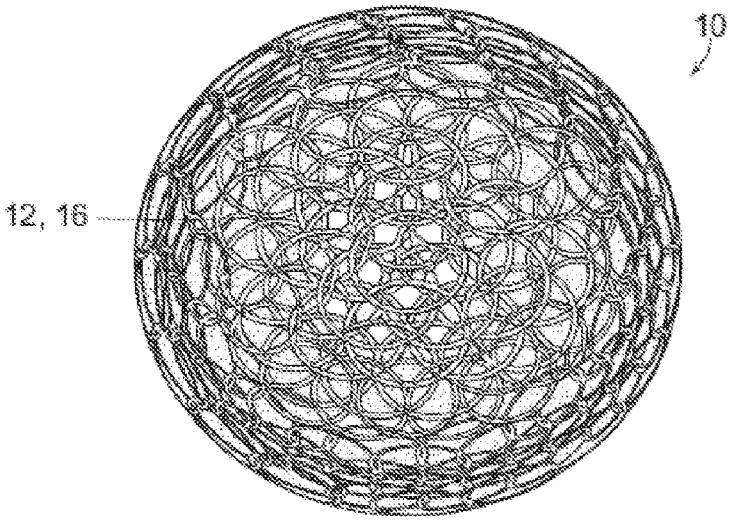
Figure 25:
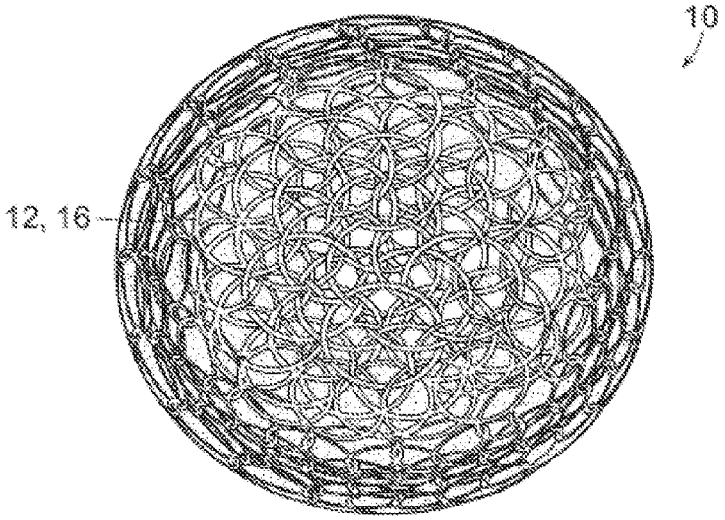
Figure 26:
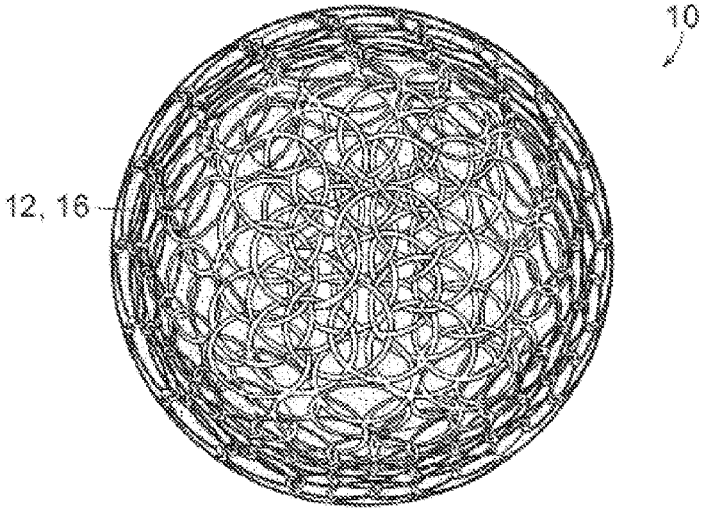
Figure 29:
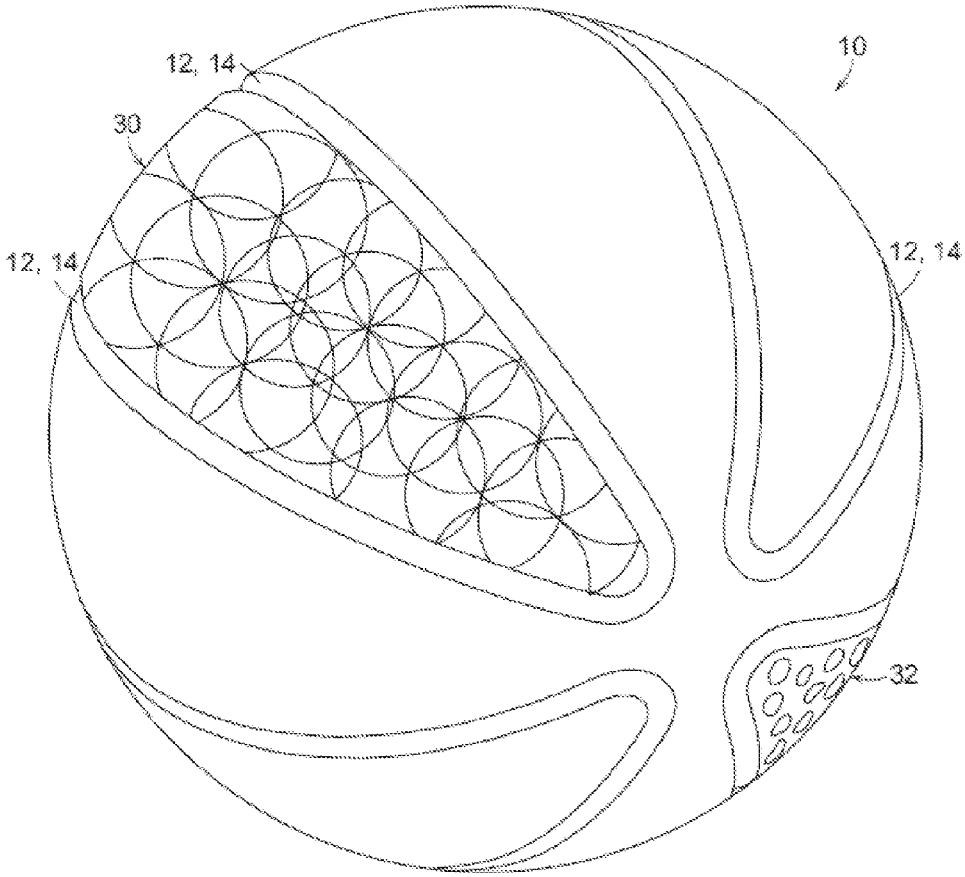
FIG. 29 shows an exemplary channel pattern wherein the spaces between the primary channel system are filled with a secondary channel system, texture, or dimples.

However, it may be desirable to include dimples, bumps, pimples (inverted dimples), or other surface textures on the golf ball surface in addition to the channels. The dimples may be circular, or may have non-circular perimeters such as oval, hour-glass shape, regular and irregular polygons. Accordingly, the dimples may be triangular, rectangular, pentagonal, hexagonal, or any other suitable polygonal shape or non-polygonal shapes, or may have polygonal and non-polygonal portions. Another advantage of the present invention is that bands 12 having a variable width provide more efficient demarcation lines or groupings of both traditional and non-traditional dimples. Exemplary non-traditional dimples include the surface textures and band systems shown in FIGS. 15-26. In one example, the surface pattern shown in FIGS. 24 and 25 are added to a portion of ball 10, illustrated in FIG. 29 at grouping 30. All surface patterns disclosed in this parent application can be used in the present invention. This pattern may be added to all the areas not covered by channels 12, or combinations of distinct patterns can be used. Traditional circular dimples can also be used, as shown in grouping 32. Non-traditional dimples such as figure-eight or barbell dimples can be used as well.

Figure 30:
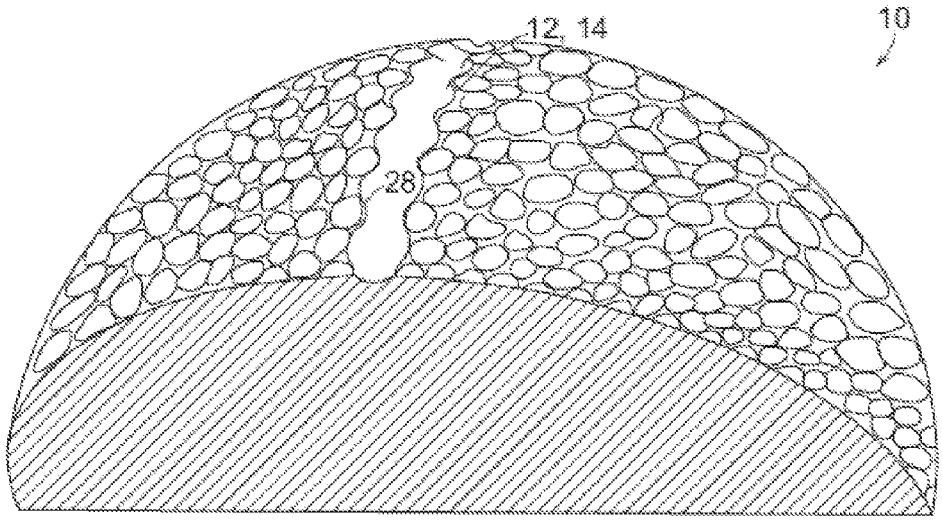
FIG. 30 shows an exemplary channel pattern and dimples.

The channels are combined with dimples to increase the percentage of golf ball surface covered in dimples and channels to a level comparable to or greater than traditional golf balls. In one example, the surface coverage of bands 12 is in between about 5% to about 40% and the dimple coverage can be from about 40% to about 90%, with a total dimple/band coverage ranging from about 60% to 100%. More preferably, the total dimple/band coverage ranges from about 70% to 90%, and most preferably from about 75% to 85%. The synergistic combination of traditional dimples and a variable width band can be seen in FIG. 30. In this embodiment, variable width of channel 14 allows channel 14 and dimples 28 to achieve tighter packing on surface of golf ball 10. The waviness of the width of channel 14 can accept circular dimples at the troughs of the waves, to increase dimple packing. Channel 14 may also overlap the parting line from the molding process, thereby masking the parting line. Thus, overall surface coverage increases over either the use of non-variable width channels along with dimples or dimples alone.

In another embodiment, as seen in FIGS. 9-11, channel 14 is dis- or non-continuous, wherein the channel takes the form of hash marks or dotted-line appearance with land area interspersed within an otherwise continuous band. This allows another unique aerodynamic package, by providing additional methods of perturbing the boundary layer flow.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball comprising an outer land surface and a surface pattern system comprising at least one band defined on the land surface, wherein the surface pattern system covers from about 5% to about 40% of the outer land surface, and wherein the width of the at least one band varies along its length, and wherein the at least one band comprises a raised bead.

2. The golf ball of claim 1, wherein the outer land surface further comprises a plurality of dimples and the dimples cover about 40% to about 90% of the outer land surface.

3. The golf ball of claim 2, wherein the at least one band and the dimples together cover about 60% to about 100% of the outer land surface.

4. The golf ball of claim 3, wherein the at least one band and the dimples together cover about 70% to about 90% of the outer land surface.

5. The golf ball of claim 4, wherein the at least one band and the dimples cover about 75% to about 85% of the outer land surface.

6. The golf ball of claim 2, wherein the at least one band covers from about 5% to about 20% of the outer land surface.

7. The golf ball of claim 6, wherein the at least one band covers from about 5% to about 10% of the outer land surface.

8. The golf ball of claim 2, wherein the dimples comprise circular dimples.

9. The golf ball of claim 2, wherein the dimples comprise non-circular dimples.

10. The golf ball of claim 1, wherein the at least one band has a height that varies along its length by about 0.002 inches to about 0.025 inches.

11. The golf ball of claim 10, wherein the height varies along its length by about 0.005 inches to about 0.015 inches.

12. The golf ball of claim 1, wherein the at least one band has a width that varies along its length by about 0.005 inches to about 0.245 inches.

13. The golf ball of claim 12, wherein the width varies along its length by about 0.010 inches to about 0.195 inches.

14. The golf ball of claim 1, wherein the at least one band has a height at its highest point of about 0.005 inches to about 0.030 inches.

15. The golf ball of claim 14, wherein the height at its highest point is about 0.010 inches to about 0.020 inches.

16. The golf ball of claim 1, wherein the at least one band has a width at its widest point of about 0.050 inches to about 0.250 inches.

17. The golf ball of claim 16, wherein the width at its widest point is about 0.100 inches to about 0.200 inches.

* * * * *